US005553335A

United States Patent [19]

Lahtinen

[11] Patent Number: 5,553,335

[45] Date of Patent: Sep. 10, 1996

[54] LIFTING DEVICE FOR SICK OR MOTION-HANDICAPPED PERSON

[76] Inventor: Veli-Tapani Lahtinen, Koiso, FIN-33980 Pirkkala, Finland

[21] Appl. No.: 256,958

[22] PCT Filed: Jan. 27, 1993

[86] PCT No.: PCT/FI93/00024

§ 371 Date: Sep. 9, 1994

§ 102(e) Date: Sep. 9, 1994

[87] PCT Pub. No.: WO93/14732

PCT Pub. Date: Aug. 5, 1993

[30] Foreign Application Priority Data

| | | | |
|---|---|---|---|
| Jan. 27, 1992 | [FI] | Finland | 920073 |
| May 11, 1992 | [FI] | Finland | 920347 |

[51] Int. Cl.[6] ..... A61G 7/10

[52] U.S. Cl. ..... 5/81.1 C; 5/83.1; 5/88.1; 212/97

[58] Field of Search ..... 5/81.1, 83.1, 87.1, 5/88.1; 212/97; 414/921

[56] References Cited

U.S. PATENT DOCUMENTS

| | | | |
|---|---|---|---|
| 1,050,814 | 1/1913 | Demeree . | |
| 1,738,758 | 12/1929 | Cottman . | |
| 2,918,718 | 12/1959 | Oberwegner | 5/88.1 X |
| 4,000,530 | 1/1977 | Green | 5/87.1 |
| 4,202,064 | 5/1980 | Joergensen | 5/83.1 |
| 4,639,955 | 2/1987 | Carminati et al. | 5/81.1 |
| 5,072,840 | 12/1991 | Asakawa et al. | 5/83.1 X |
| 5,406,658 | 4/1995 | Olkkonen et al. | 5/87.1 X |

FOREIGN PATENT DOCUMENTS

| | | |
|---|---|---|
| 0519735A2 | 12/1992 | France . |

*Primary Examiner*—Michael F. Trettel
*Attorney, Agent, or Firm*—Hamilton, Brook, Smith & Reynolds, P.C.

[57] ABSTRACT

A lifting device for sick or motion-handicapped persons is disclosed. In the lifting device (1), both ends of the lifting belt (*7a,7b*) are fixed onto the central shaft of a belt wheel (5), and thus when a lifting motor (3) rotates the belt reel (5) via a reduction gear, both ends of the belt (*7a,7b*) are spirally wound on the belt reel (5), and, respectively, when the belt reel (5) rotates in the opposite direction, the belt (*7a,7b*) is freed from the belt reel (5). Hence, as the lifting is carried out supported at two points by means of the belt, the lifting will take place very smoothly and the lifting device will not twist.

14 Claims, 3 Drawing Sheets

LIFTING DEVICE FOR SICK OR MOTION-HANDICAPPED PERSON

FIELD OF THE INVENTION

The invention relates to a device for lifting a sick or motion-handicapped person, comprising a housing, a lifting motor disposed within the housing, a belt reel connected for rotation by the lifting motor, coupling means controlling the direction of rotation of the lifting motor, and a belt.

BACKGROUND OF THE INVENTION

Previously known are for instance combined devices facilitating moving and lifting, which support the patient's walk and have handles which can be moved up and down, thus aiding the ascent and descent of the patient. Such walking supports provided with several wheels are known in electrically driven models wherein charged batteries serve as the energy source, or in pneumatically driven models wherein compressed-air batteries serve as the energy source. Further, lifting devices fixed to the ceiling, a rail or a jib, wherein the lifting movement is performed with one belt are known. Other devices further have a transverse bearer bar at the lower end of the belt. A device fixed to a jib located above the bed and supporting the patient or a frame with four belts is also known. However, the above-stated device does not perform the actual lifting movement, which is performed by the bed. Further, lifting devices on wheels are known, wherein one belt, a jib, or a rigid frame performs the lifting movement. In devices of this kind, the person can indeed be supported at four points, but the actual lifting is carried out with one belt, jib or frame.

The above devices are in fact suitable for lifting the patient at the location of said devices, but they have not been designed as devices that are transported and portable. Moreover, the lifting construction will easily become rather heavy, and the use thereof often requires that the user is well familiar with the device. With the aid of such a walking support, one can get out of bed from a sitting posture, but one cannot get up in bed from a recumbent posture to a sitting posture.

Norwegian publication No. 160 176 discloses an apparatus wherewith the lifting of a wheelchair patient and his moving from one location to another can be facilitated. The apparatus comprises a jib enabling displacement of the lifting machinery in the vertical direction, and fixing means connected to the other end of said jib wherewith the entire apparatus can be fixed for example onto the roof of a car similarly as a roof rack. Further, rails along which the jib can also move in the horizontal direction are fitted to the roof fasteners. The actual unit is connected through connecting means to a carriage mounted in connection with the jib and enabling a vertical movement, and control means for the unit are fitted at one end thereof and a seat suspended on a belt at the other end thereof. Thus, in a lateral view the actual unit is an elongated rectangular device. A horizontally disposed screw is provided within a housing, and therewith the first roll in a pair of rolls is moved in the horizontal plane, while the other roll serves as a diverter roll. The horizontal movement of the first roll is duplicated at the ends of the lifting belt, since the other end of the belt is fixed at the locus of the roll that serves as a diverter roll.

Even though the device has been constructed to be portable, it is difficult or even practically impossible for a handicapped person to use, since the device must be fixed separately onto the roof of a car or to some other corresponding location, which is impossible for a sick or handicapped person. Further, a screw as a solution is difficult to adjust, and such a screw requires a considerable space, which will necessarily make the lifting device unreasonably large, thus making it impossible for a motion-handicapped person to handle by himself. Since in the solution of said Norwegian publication the lifting is performed with one belt, the lifting and lowering operation is very unstable from the point of view of the patient. Further, it is to be noted that said device is intended almost solely for use in connection with cars to facilitate the patient'moving out from the car or into the car, respectively, and therefore it is very difficult to use for instance in the interiors of a hospital where it requires a separate system for fastening to the ceiling or a wall. Also, said solution will be very expensive.

SUMMARY OF THE INVENTION

The object of this invention is to facilitate the moving of sick or motion-handicapped person and simultaneously to make it possible for the person to move independently with the aid of said lifting device. This invention is characterized in that the belt comprises a pair of belts fixed onto the same belt reel in such a way that the pair of belts is wound on the belt reel smoothly and spirally, one belt on top of the other.

The essential idea of the invention is that the lifting belt of the lifting device is fixed onto the belt reel in such a way that when the lifting belts are wound on the reel, they are wound one on top of the other simultaneously spirally and, respectively, when the lifting belts are unwound from the belt reel, they are let spirally loose from the superimposed arrangement. Further, the essential idea of the invention is that at least a pair of belts is employed for the lifting, whereby the lifting and lowering operation will be made very stable. An essential feature is also that with said arrangement the lifting device can be reduced to a very small size, as a result of which it will be very light, thus enabling the lifting device to be carried by. Further, an essential idea is that as the lifting device is made sufficiently light, a battery drive facility can be connected thereto, and thus the use of the lifting device is not tied to any certain location for the supply of energy to the lifting device, but it may be used at any location, the batteries serving as a source of energy.

The essential advantage of the invention is that by means of a common belt reel, two lifting belts can be moved simultaneously, whereby the lifting operation is made very stable while the person to be lifted feels safe. Further, with the belt reel arrangement it is possible to reduce the size of the lifting device considerably, which will make the device easy to carry by. A small size also enables the use of batteries as an energy source. Further, the lifting device is made very light and thereby easy to carry by. It is also very simple to use, as a result of which it is easy for the patient to learn the use of the device himself. Since the lifting device is light, the patient or motion-handicapped person can use it by himself and place it in suitable lifting locations as he chooses.

BRIEF DESCRIPTION OF THE DRAWINGS

The invention will be explained more closely in the accompanying drawings, in which.

DETAILED DESCRIPTION OF THE PREFERRED EMBODIMENTS

Figure 1:
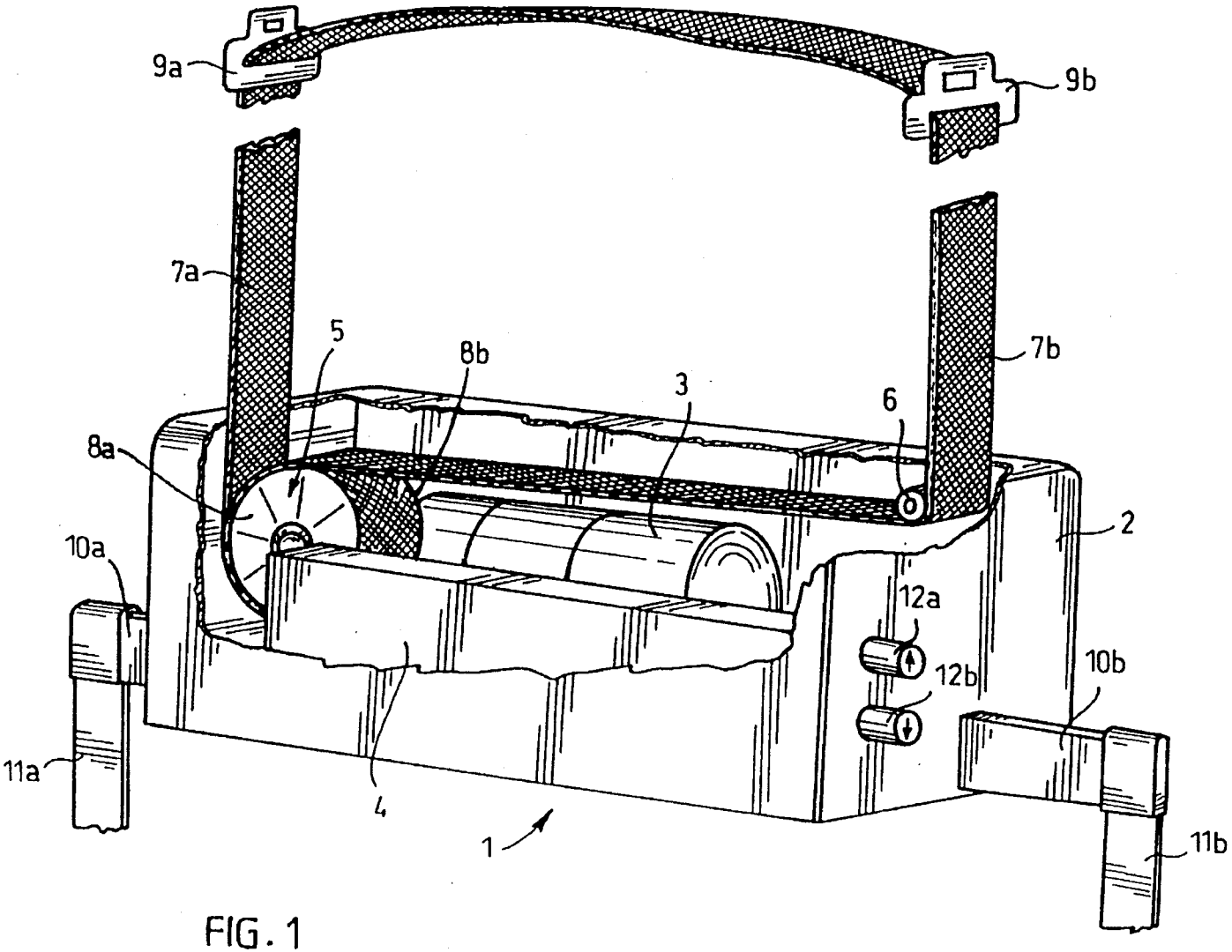
FIG. 1 shows a portable lifting device according to the invention in a partial cut-away view.

FIG. 1 shows in a partial cut-away view a lifting device 1 comprising a housing member 2 constituting the body of the device, a motor 3 disposed within the housing 2, said motor most preferably being a DC motor, a battery set 4 serving as an energy source, preferably comprising several small discrete battery cells, a belt reel 5 connected to the motor 3 via a reduction gear, and a diverter pulley 6 guiding the belt. A belt 7*a* and 7*b* is connected to the belt reel 5 in such a way that the belts 7*a* and 7*b* are wound simultaneously on the body of the belt reel 5 spirally one on top of the other, guided by the walls 8*a* and 8*b* of the belt reel 5. The belts 7*a* and 7*b* most preferably constitute a unity, and thus when the belts 7*a* and 7*b* are wound on the belt reel 5 by means of the motor 3, a convenient carrying handle is provided by the unitary belt, which in itself facilitates the carrying of the device. Further, fixing means 9*a* and 9*b* can be attached to the unitary belt, wherewith the lifting device 1 can be suspended for instance from the ceiling. Since the suspension is at two points, the lifting device cannot twist and is therefore much more stable to handle. Arms 10*a* and 10*b* for a lifting seat are provided in the lower part of the housing 2, and the length of said arms can be adjusted in a dependence of the width of the patient or the motion-handicapped person. The lifting seat is connected to the arms 10*a* and 10*b* by means of lifting seat belts 11*a* and 11*b*. The direction of rotation of the lifting motor 3 and thereby the lifting motions of the lifting device can be regulated by means of control knobs 12*a* and 12*b*. When the lifting device 1 has been suspended by means of fixing means 9*a* and 9*b* for instance from the ceiling, the person sitting in the lifting seat may regulate his lifting or lowering movement easily by means of control knobs 12*a* and 12*b*, since the distance to the lifting device 1 does not change.

Figure 2:
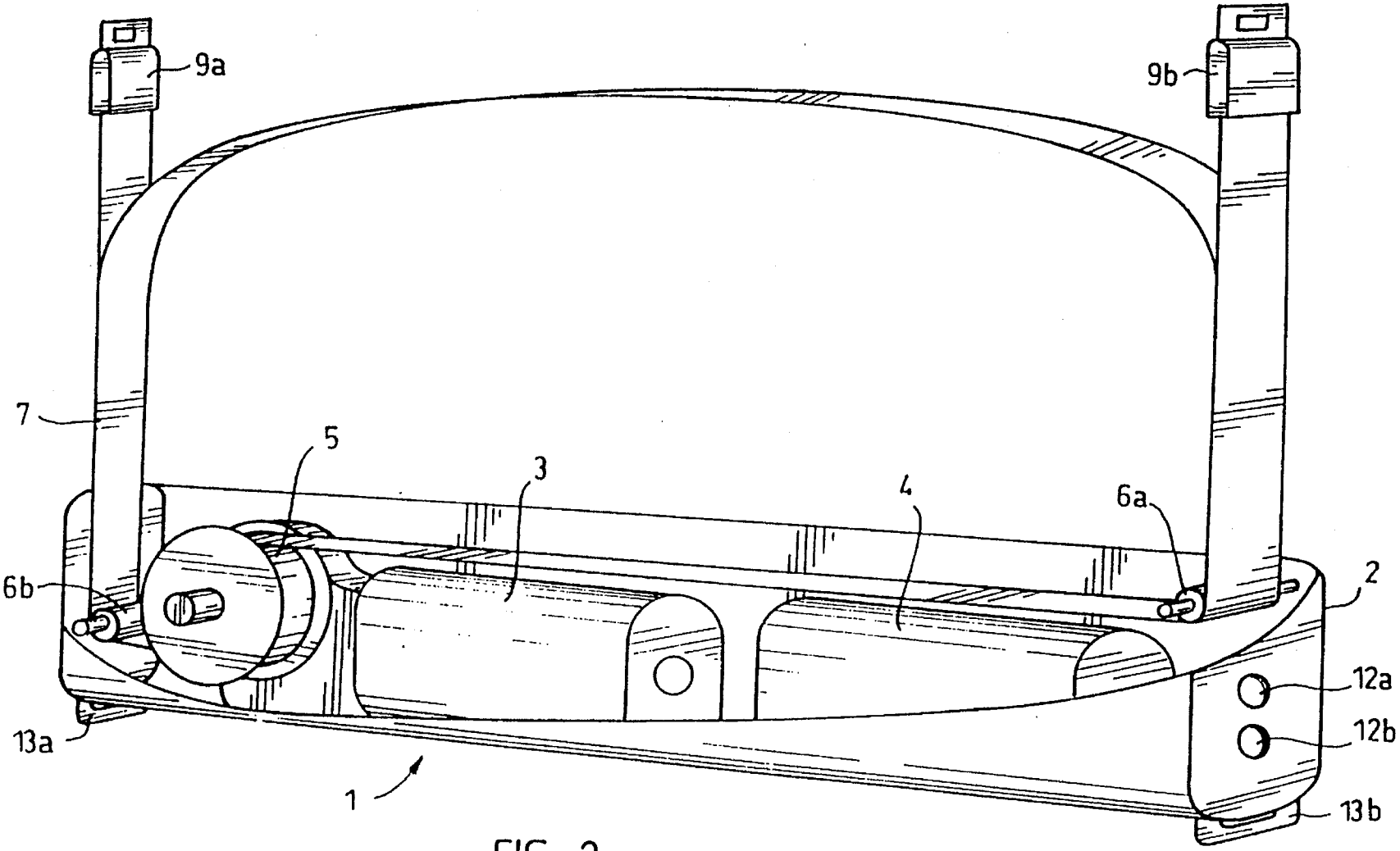
FIG. 2 shows another preferred portable lifting device according to the invention in a partial cut-away view.

FIG. 2 shows another advantageous embodiment of the lifting device of the invention. The numbering of FIG. 2 corresponds for its part to the numbering of FIG. 1. The lifting device 1 comprises a housing 2 which simultaneously constitutes the body of the lifting device 1. Further, within the housing 2 are placed a motor 3, a battery 4, a belt reel 5, and diverter pulleys 6*a* and 6*b* wherethrough the lifting belt 7 which is shown by way of example as a unity in FIG. 2 is wound on the belt reel 5. The belt 7 further has fixing means 9*a* and 9*b* for fixing the lifting device to rails or similar for suspension. The belt reel 5 is connected to the motor 3 via a reduction gear. As the motor rotates the belt reel 5, the belt 7 is wound with its both ends on the belt reel 5 spirally in layers, and thus the winding is very smooth and the belt 7 can be wound by means of one belt reel 5 from both ends smoothly into the lifting device 1. The bottom of the housing 2 has apertured plates 13*a* and 13*b* bored for a fixing hook, replacing the arms 10*a* and 10*b* shown in FIG. 1; from these plates the corresponding lifting seat belts 11*a* and 11*b* can be suspended. Further, FIG. 2 shows control knobs 12*a* and 12*b* made flush with the surface of the housing 2, on account of which it is impossible to inadvertently push the lifting motor 3 on and thereby cause running down of the batteries 4 when the lifting device 1 is being transported. It is to be noted that the diverter pulleys 6*a* and 6*b* are placed with the housing 2 in such a way that when the lifting device 1 is fixed to the ceiling or the jib by means of fixing means 9*a* and 9*b*, the downright pulling force is changed, by means of the diverter pulleys 6*a* and 6*b*, into a force pressing the housing 2 in the longitudinal direction, and further when the apertured plates 13*a* and 13*b* are on the imaginary extension of belt 7, only a downright pulling force is produced in the apertured plates 13*a* and 13*b*, and thus no bending force is exerted on the housing 2. Further, such placing of the diverter pulleys 6*a* and 6*b* substantially diminishes stress on the bearings on the secondary side of the reduction gear, since the forces exerted on the belt reel 5 have substantially the direction of its tangent. Thus the housing can be manufactured of a fairly thin material and thereby made very light.

Figure 3:
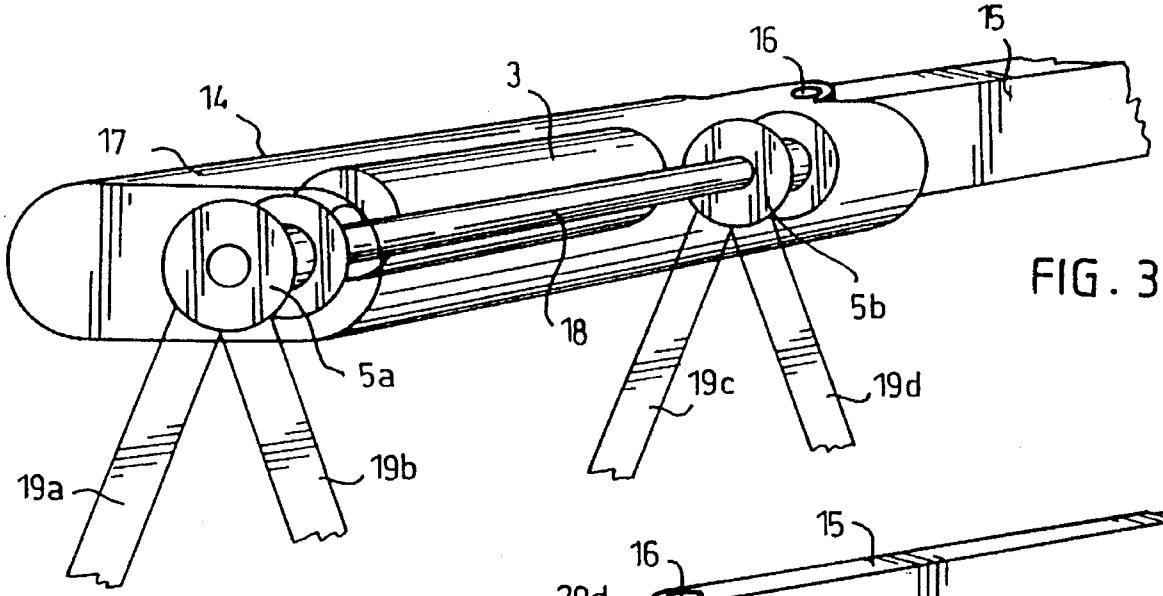
FIG. 3 shows a attachable lifting device according to the invention in a partial cut-away view.

FIG. 3 shows an embodiment of the lifting device according to the invention wherein the lifting device 14 can preferably be mounted for instance to a jib 15 on a hospital bed to be pivoted about a hinge pivot 16. A lifting motor 3 and reels 5*a* and 5*b* interconnected with a shaft 18 are placed within the housing 17 of the lifting device 14, as above. The shaft 18 may be connected to the motor 3 directly by means of a belt drive or via a reduction gear, in which case the shaft 18 can be rotated in the desired manner. Belts 19*a* and 19*b* as well as 19*c* and 19*d*, wound by means of belt reels 5*a* and 5*b* as set forth above spirally in layers, are further connected to the belt reels 5*a* and 5*b*. The walls of the belt reels 5*a* and 5*b* guide the setting of the belts on the belt reels. The motor 3 may be driven directly by mains current or, if desired, a battery arrangement as set forth above, in which case particular care will be taken of the safety of the patient. By means of belts 19*a* and 19*b* as well as 19*c* and 19*d*, a person positioned in a lifting bag, in a harness or in a lifting frame can be lifted. In this situation, the lifting operation is very smooth and takes place simultaneously at the head and feet of the person, thus giving no feeling of insecurity to the person or patient.

Figure 4:
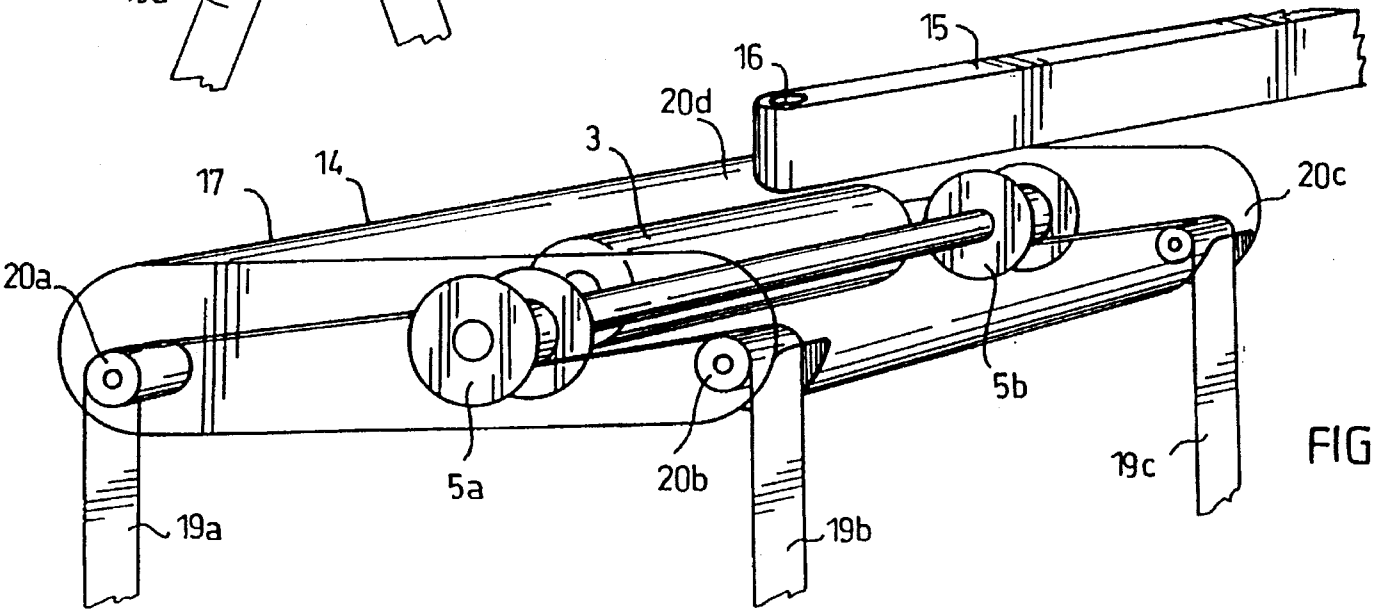
FIG. 4 shows another attachable lifting device according to the invention in a partial cut-away view.

FIG. 4 shows an embodiment of the lifting device of the invention, wherein diverter pulleys 20*a*–20*d* fitted at each end of the device are utilized. In other respects, the numbering of FIG. 4 corresponds to that of FIG. 3. The lifting device 14 is intended for use particularly in situations where it is impossible to employ a high lifting elevation, but the patient must be lifted very near the lifting device 14. In such a situation, the lifting takes place perpendicularly against the lifting frame.

The figures and the description pertaining thereto are intended only to illustrate the idea of the invention. The invention may vary within the scope of the claims, and thus the connection of the lifting means for instance to a patient bed is possible to realize by several different means. Further, the control of the lifting device can be realized in a variety of ways. For example, it is possible to mount an infrared receiver in place of the control knobs 12*a* and 12*b*, in which case the person controlling the lifting device has a corresponding infrared remote control, thus making the lifting device easier to control. A corresponding possibility for remote control can easily be provided for with a wired remote control.

I claim:

1. A device for lifting a sick or motion-handicapped person, comprising a housing (2), a lifting motor (3) disposed within the housing (2), a belt reel (5) connected for rotation by the lifting motor (3), a controller (12*a*, 12*b*) for selecting a direction of rotation of the lifting motor, (3) and diverter pulleys (6*a*, 6*b*) for guiding a belt onto the belt reel, (5) wherein the belt (7) comprises a pair of belts (7*a*,7*b*) fixed onto the same belt reel (5) in such a way that the pair of belts (7*a*,7*b*) is wound on the belt reel (5) smoothly and spirally, one belt on top of the other, characterized in that the pair of belts, (7*a*,7*b*) forms a unitary belt loop (7).

2. A device as claimed in claim 1, characterized in that at least two belt reels (5*a*,5*b*) are connected for rotation by the lifting motor (3), to each of which a pair of belts (19*a*,19*b*) is connected.

3. A device as claimed in claim 2, characterized in that the housing (2) is fixedly secured to a support jib (15).

4. A device as claimed in claim 1, characterized in that the lifting device (1) is adapted to be suspended by the belt (7), whereby when the belt (7) is wound on the belt reel (5) the housing (2) is lifted upward.

5. A device as claimed in claim 4, characterized in that the unitary belt loop (7) forms a carrying handle for the lift device (1).

6. A device as claimed in claim 1, characterized in that the diverter pulleys (6*a*,6*b*) are mounted to guide the belt (7) in such a way that an imaginary extension of the belt (7) passes through apertured plates (13*a*, 13*b*).

7. A device as claimed in claim 1, characterized in that a rechargeable battery set (4) serves as an energy source for the lifting motor (3).

8. A device for lifting a sick or motion-handicapped person, comprising:

a housing;

a lifting motor disposed within the housing;

a belt reel connected for rotation by the lifting motor;

controls for selecting a direction of rotation of the lifting motor;

a pair of belts, forming a unitary belt loop, fixed onto the belt reel so that the pair of belts is wound on the belt reel smoothly and spirally, one belt on top of the other; and diverter pulleys for guiding the belt onto the belt reel.

9. A device as claimed in claim 8, wherein at least two belt reels are connected for rotation by the lifting motor, to each of which a pair of belts is connected.

10. A device as claimed in claim 9, wherein the housing is fixedly secured to a support jib.

11. A device as claimed in claim 8, wherein the lifting device is intended to be suspended by the belt so that when the belts are wound on the belt reel the housing is lifted upward.

12. A device as claimed in claim 11, wherein the unitary belt loop forms a carrying handle for the lift device.

13. A device as claimed in claim 8, the diverter pulleys are mounted to guide the belts in such a way that an imaginary extension of the belts passes through apertured plates.

14. A device as claimed in claim 8, further comprising a rechargeable battery which is a power source for the lifting motor.

* * * * *